US005570882A

United States Patent [19]

Horkan

[11] Patent Number: 5,570,882

[45] Date of Patent: Nov. 5, 1996

[54] FOOTBALL TRAINING AID

[76] Inventor: Noel P. Horkan, 99-32 64 Ave., Rego Park, N.Y. 11374

[21] Appl. No.: 567,548

[22] Filed: Dec. 5, 1995

[51] Int. Cl.[6] ..... A63B 43/00; A63B 69/00

[52] U.S. Cl. ..... 273/65 EG; 273/346; 273/DIG. 30

[58] Field of Search ..... 273/55 R, 65 R, 273/65 E, 65 EG, 346, DIG. 30, 60 A

[56] References Cited

U.S. PATENT DOCUMENTS

| | | | |
|---|---|---|---|
| 2,011,760 | 8/1935 | Gallinant | 273/65 EG |
| 2,448,731 | 9/1948 | Park | 273/60 A |
| 3,953,030 | 4/1976 | Muchnick | 273/65 E X |
| 4,869,504 | 9/1989 | Kralik | 273/65 EG X |
| 5,133,550 | 7/1992 | Handy | 273/65 EG X |
| 5,183,263 | 2/1993 | Kuebler | 273/65 EG |
| 5,195,745 | 3/1993 | Rudell et al. | 273/65 EG |
| 5,316,294 | 5/1994 | Turangen | 273/65 EG |
| 5,383,660 | 1/1995 | Adler et al. | 273/65 EG |

*Primary Examiner*—William H. Grieb
*Attorney, Agent, or Firm*—Chase & Yakimo

[57] ABSTRACT

A football training aid comprises a modified football having a lacing with Velcro® loop elements therein. The football is grasped by a user wearing a glove having Velcro® hook elements only at the fingertips thereof. The restriction of the Velcro® elements to the football lacing and the fingertips of the glove urges the user to grasp the football only at the laces so as to impart a proper spin thereto upon subsequent throwing.

18 Claims, 6 Drawing Sheets

FOOTBALL TRAINING AID

BACKGROUND OF THE INVENTION

This invention relates to a training aid and, more particularly, to a modified football and glove combination which assists in teaching a player to correctly grasp and throw a football.

The effective throwing of a football is not always readily learned, particularly in the case of a young football player. The smaller hands of a younger player makes it difficult to properly grasp a football. Such players usually have to cradle the ball in a palm up fashion so as to accomplish a passing action. This type of ball manipulation results in incorrect passing techniques that must later be corrected. Thus, the correct hand placement of the thrower's fingers atop the football lacing is an important aspect in correctly throwing a football. Accordingly, it is desirable to present a training aid which urges an initial, correct interaction between the passer's fingers and football lacing which enhances the development of a proper throwing grip.

Known prior art devices have not addressed the above problems. In one patent a football is disclosed having Velcro® strips placed on the seams of a foam rubber football. The player wears a cotton glove having mating Velcro® fasteners thereon. The game is played by throwing the football with an ungloved hand and catching it with the gloved hand. Thus, the glove is said to making catching the football easier for young children. This device does not enhance a proper throwing of a football.

In another patent a modified football has Velcro® patches thereon which are designed to interact with a glove or hand strap having mating Velcro® patches thereon. The interaction of the glove with the patches is said to spin the football into a proper spiral upon throwing. However, the placement of the Velcro® patches does not assure that the ball is properly grasped only at the lacing. Moreover, the fixation of the Velcro® materials to the ball interferes with the normal football function.

In response thereto I have invented a training aid in the form of a modified football and glove. The modified football utilizes laces having one element of a Velcro® fastener combination thereon. A flexible glove has the complementary mating elements of the Velcro® fastener combination only at the fingertips thereof. The use of the Velcro® only on the laces forces the gloved user to properly grasp the football only at such laces. The Velcro® laces do not interfere with the normal game play by ungloved players.

It is therefore a general object of this invention to provide a training aid in the form of a modified football and glove combination which assists in proper throwing of a football.

Another object of this invention is to provide a training aid, as aforesaid, in which the laces of a football are made of a Velcro® fastener element, the laces designed to interact with a complementary Velcro® fastener element on the fingertips of a glove.

A further object of this invention is to provide a training aid, as aforesaid, which does not interfere with normal game play by ungloved players.

Still another object of this invention is to provide a training aid, as aforesaid, which properly imparts a spin to a thrown football.

Still another object of this invention is to provide a training aid, as aforesaid, which improves the user's grasping and control of the football.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
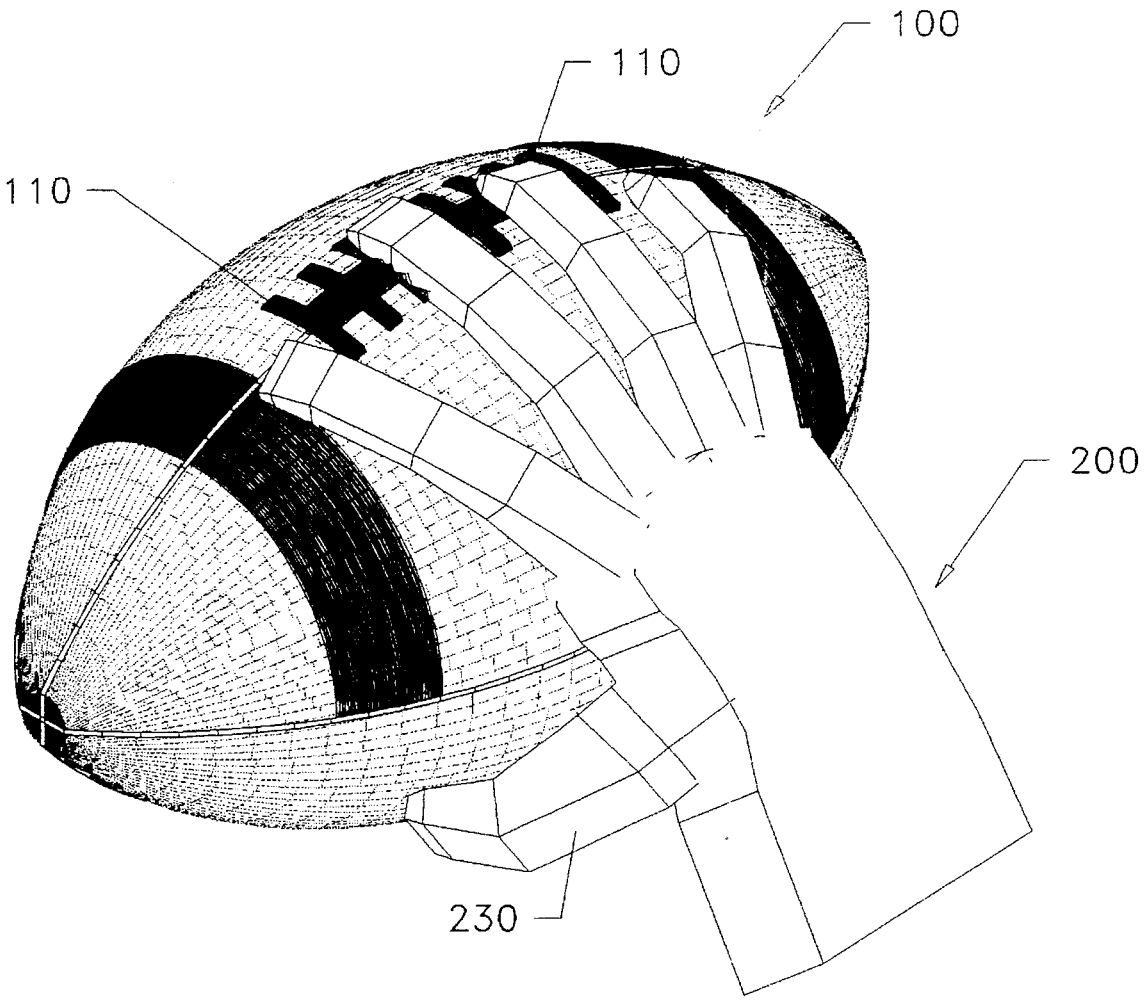
FIG. 1 is a perspective view showing a right handed user gripping a modified football with glove.
Figure 2:
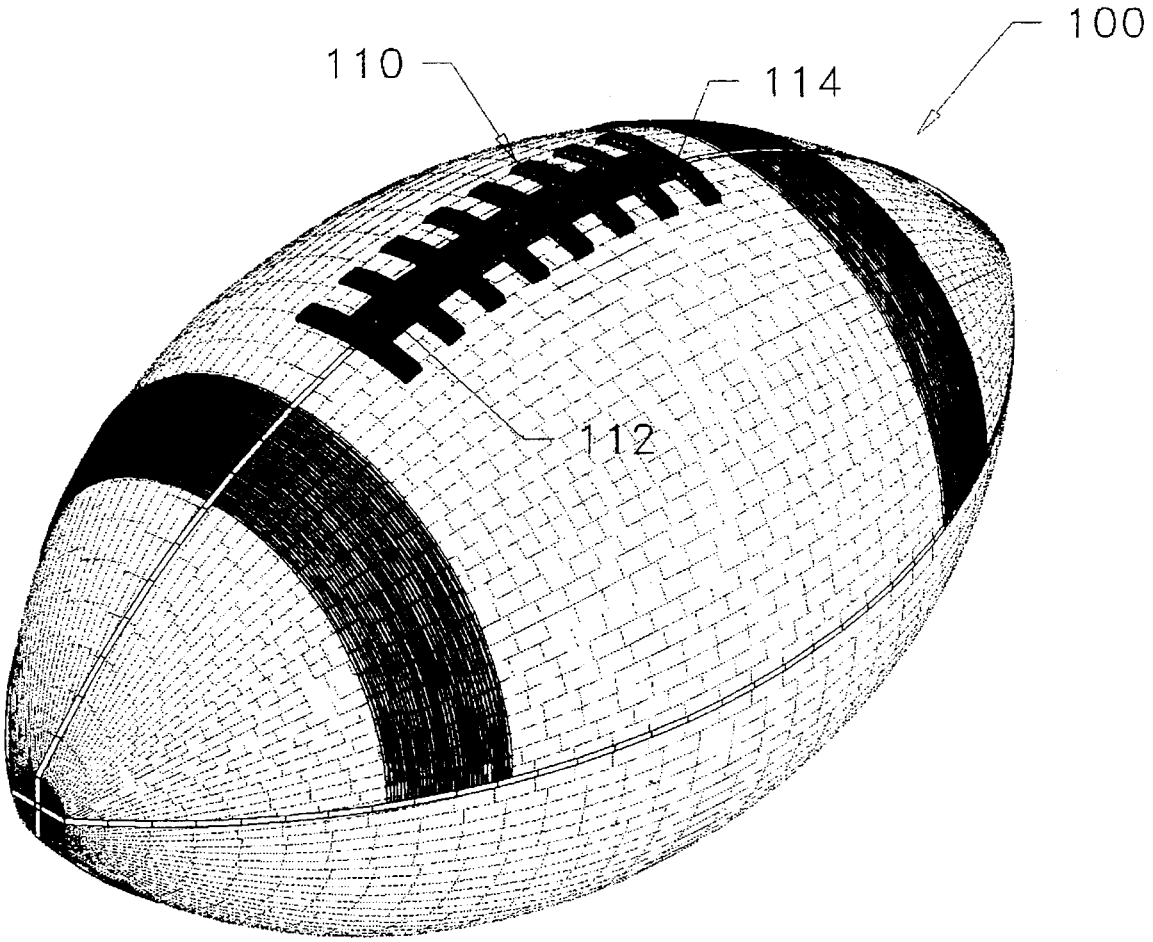
FIG. 2 is a perspective view of the modified football of FIG. 1.
Figure 4:
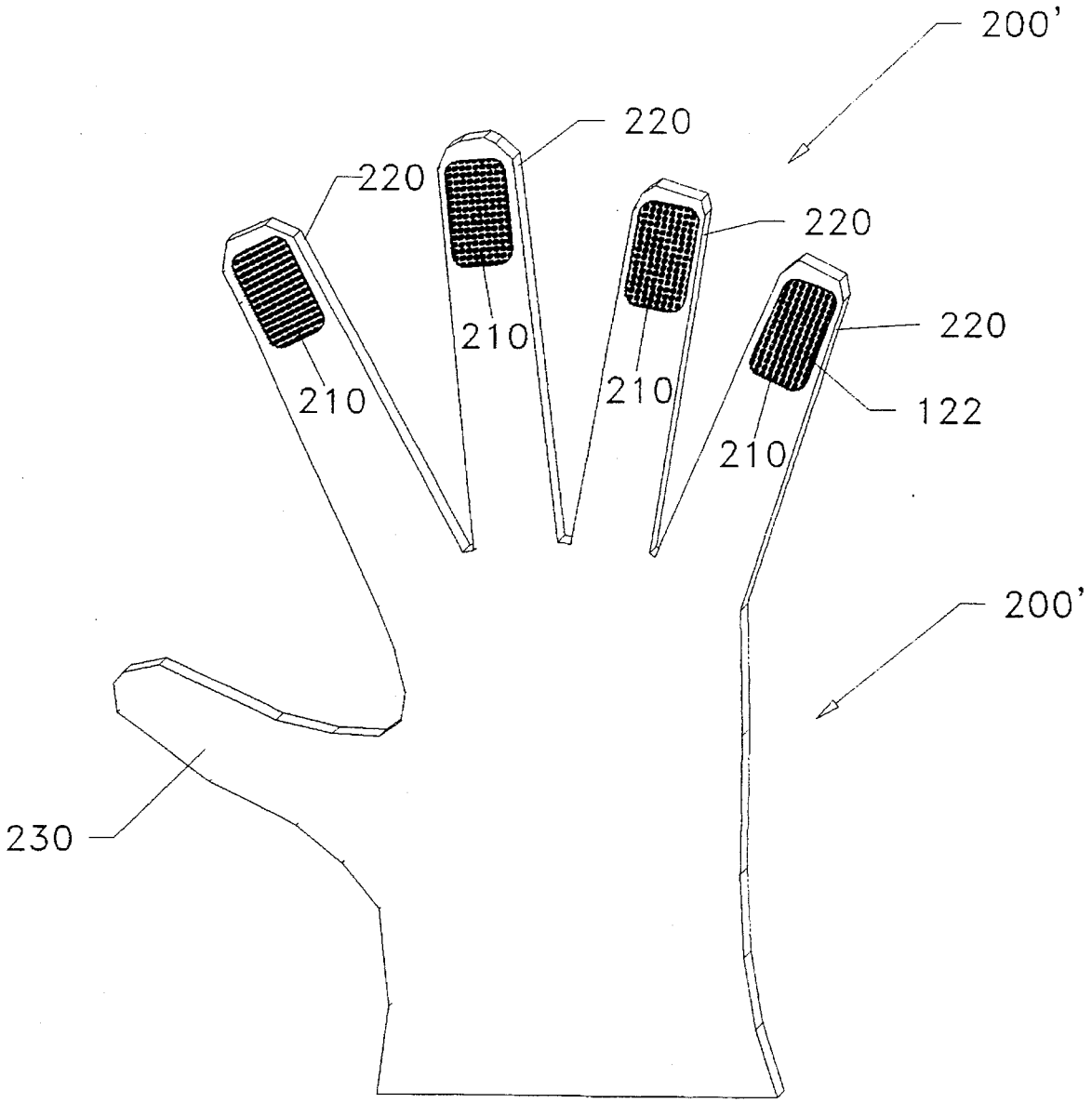
FIG. 4 is an elevation view of a left handed glove for gripping the football.
Figure 5:
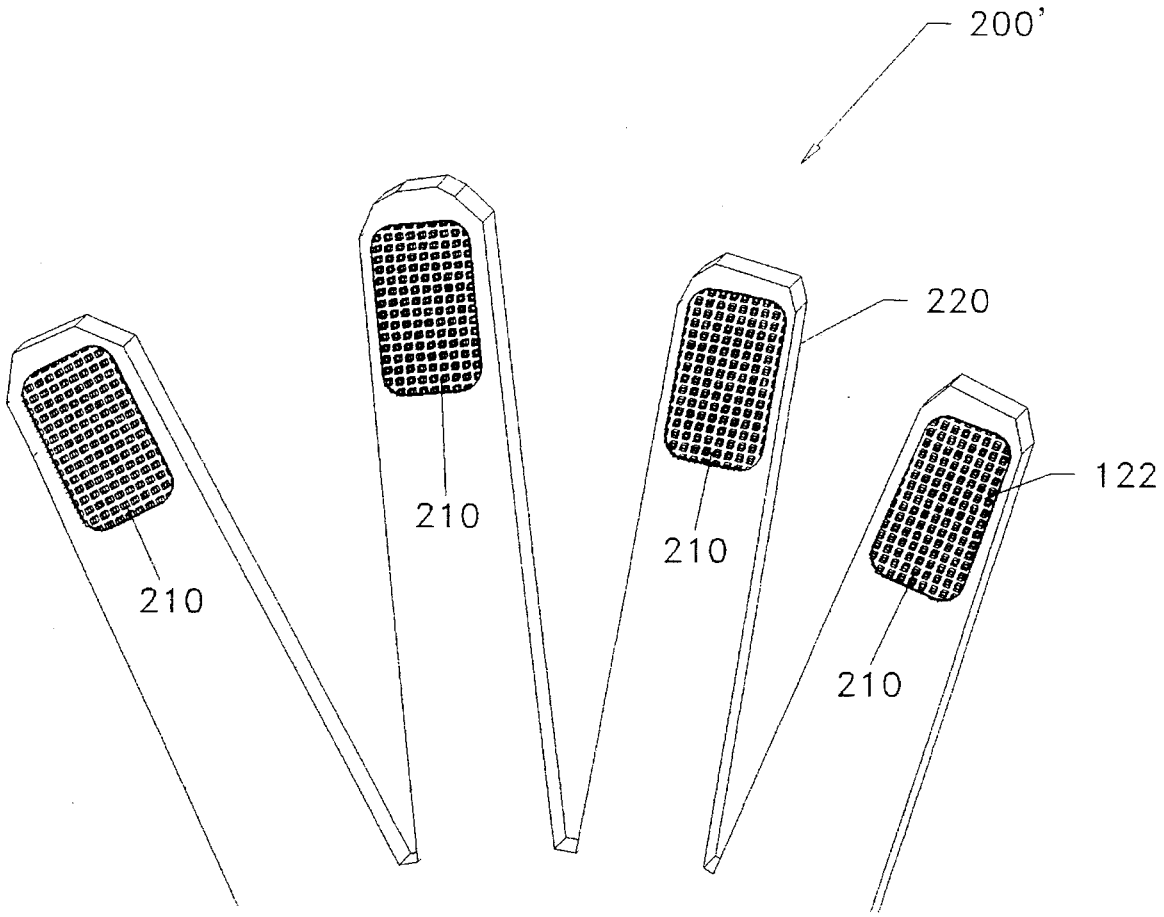
FIG. 5 is an enlarged view of the fingers of the glove of FIG. 4.
Figure 6:
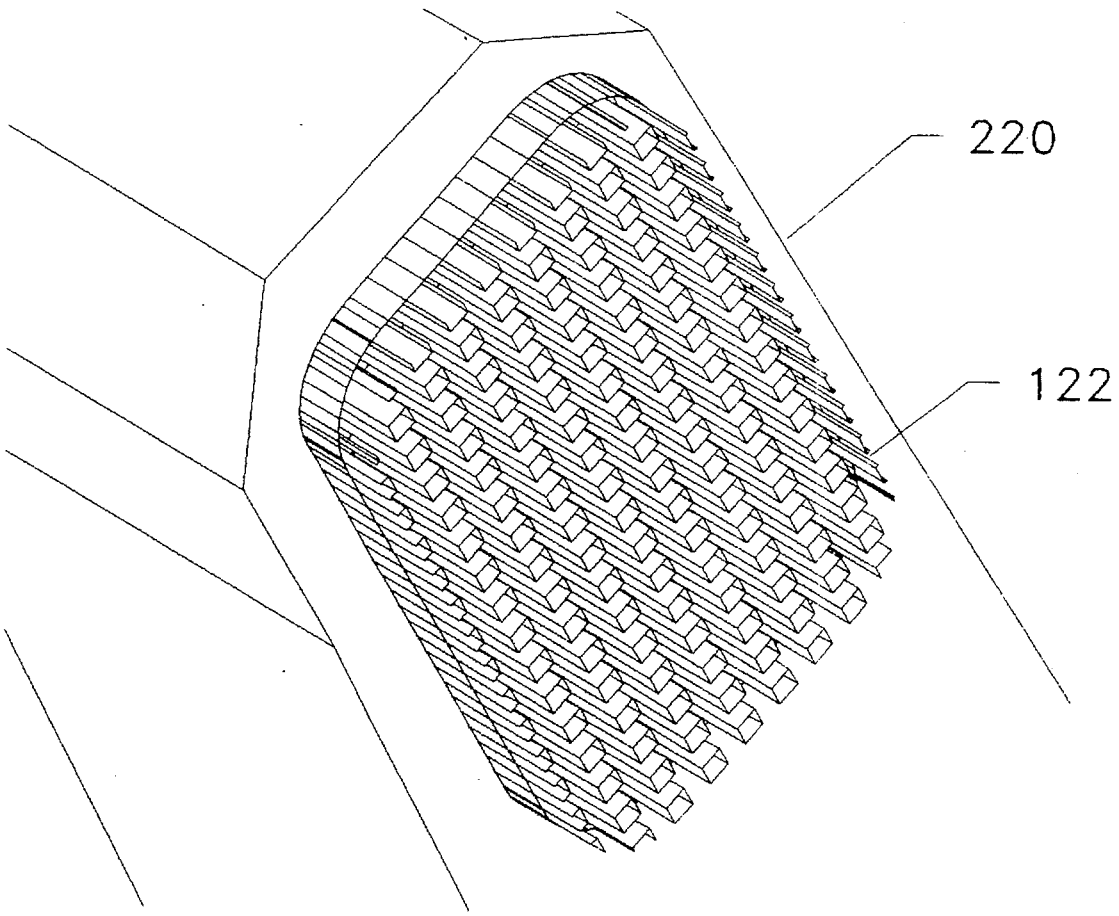
FIG. 6 is an enlarged view of one of the finger pads of the glove of FIG. 4.

Turning more particularly to the drawings, FIG. 1 shows the football 100 utilizing lacing 110 having Velcro® fastener elements 120 thereof preferably of the loop-type design, the loop type elements 120 being less susceptible to damage or sticking to clothing or other items during game play. Football 100 is being grasped by a right handed glove 200 as shown in FIG. 1. A left handed glove 200' is shown in FIG. 4 either glove having mating pads 210 only at the top joints or fingertip portions 220. No pads 210 are on the thumb 230 of either glove 200, 200'. The complementary mating fastener elements of the Velcro® combination, i.e. the hook 122 elements, are preferably used on such pads 210. It is also understood that a combination of hook 122 and loop 120 elements may be used on the pads 210 which engage combination of complementary hook 122 and loop 120 elements found on the lacing 110 of football 100.

The restriction of the Velcro® loop elements 120 to the lacing 110 of the football 100 is important. No Velcro® materials are positioned elsewhere on the football as shown in the prior patents. Accordingly, the mating of the Velcro® elements 122 on glove 200 occurs only when the football 100 is properly grasped by a gloved 200 user at the laces 110 of football 100. This restriction urges an initial proper FIG. 1 grasping of the football 100 by a gloved 200 user only at laces 110 as the gloved user cannot effectively grasp the football elsewhere.

Figure 3:
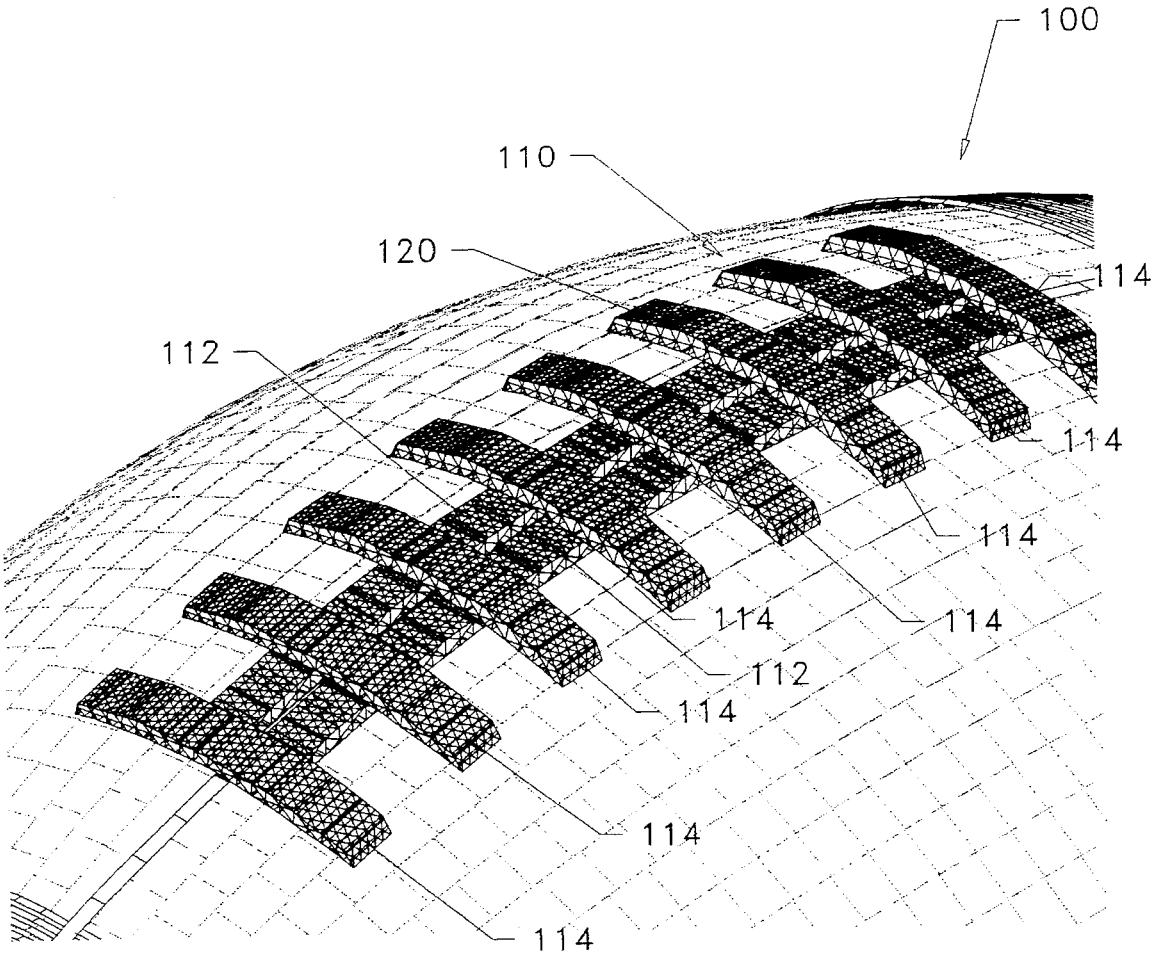
FIG. 3 is a view, on an enlarged scale, of the laces of the FIG. 1 football.

The above described lacing 110 may simply replace the original lacing of the football 100. Alternatively, the lacing may 110 take the form as shown in FIG. 3 with two longitudinal strips 112 and a plurality of shorter strips 114 traversing the longitudinal lacing strips 112 between the ends thereof. Accordingly, the pads 210 will primarily contact the traverse strips 114, such interaction effective in imparting a spin to the football 100.

The glove 200 may be of any flexible material, it being important that the pads 210 are found only at the tip portions 220 of the glove 200 fingers, i.e. in extension between the top and first joint. This pad 210 placement cooperates with the above-described lacing 110 of the football 100 to again assure that the football is properly grasped by the distal joints of the fingers of the user. (Pads 210 may appear on both sides of the fingertips so that one glove may be used by either left or right handed throwers.)

Accordingly, upon grasping the football 100, as best shown in FIG. 1, the ball 100 is properly gripped and not cradled as found with the younger user. Upon throwing the football 100, the gloved 200 hand being in a proper relationship relative to the lacing 110, will impart a spin to the football 100 so as to achieve the desired spiral effect. Of course, the degree of interaction between the mating Velcro® elements 120, 122 must be minimal so as to not to interfere with the release of the football 100.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A football training aid comprising in combination:

a football having a lacing, said lacing having a plurality of either male or female fastener elements thereon;

a flexible glove having a plurality of fingers and thumb, said fingers having distal free ends positioned adjacent the fingertips of a user wearing said glove;

a pad on at least one of the distal free ends of said glove, said pad having a plurality of mating fastener elements thereon complementary to said fastener elements on said football lacing, said mating elements on said glove worn by a user releasably engaging said mating elements on said lacing, whereby said mating of said complementary fastener elements urges a user to properly grasp said football at said lacing by a user's fingertips within said glove.

2. The device as claimed in claim 1 wherein said glove mating elements disengage from said lacing mating elements upon a user throwing said football, said disengagement imparting a spin to the football.

3. The device as claimed in claim 1 wherein said mating elements on said football lacing comprise Velcro® loop elements.

4. The device as claimed in claim 3 wherein said mating elements on said football lacing comprise Velcro® hook elements.

5. The device as claimed in claim 1 wherein said at least one pad is only on said fingers of said glove.

6. The device as claimed in claim 1 wherein said lacing comprises:

a first strip of lacing extending along a seam of a football;

a plurality of strips traversing said first strip, said traversing strips primarily engaging said pad on said at least one of the distal free ends of said glove.

7. A football training aid comprising in combination:

a football having a lacing, said lacing having either at least one male or female fastener element thereon;

a flexible glove having a plurality of fingers and thumb, said fingers having distal free ends positioned adjacent the fingertips of a user wearing said glove;

a mating fastener element on at least one of said distal free ends of said glove complementary to said at least one fastener element on said football lacing, said mating element on said glove worn by a user releasably engaging said mating element on said lacing, whereby said mating of said complementary fastener elements urges a user to properly grasp said football at said lacing by a user's fingertips within said glove.

8. The device as claimed in claim 7 wherein said glove mating element disengages from said lacing mating element upon a user throwing said football, said disengagement imparting a spin to the football.

9. The device as claimed in claim 7 wherein said mating element on said football lacing comprise Velcro® loop elements.

10. The device as claimed in claim 9 wherein said mating element on said football lacing comprise Velcro® hook elements.

11. The device as claimed in claim 7 wherein said mating element on said glove is only on said fingers of said glove.

12. The device as claimed in claim 7 wherein said lacing comprises:

a first lacing strip extending along a seam of a football;

a plurality of strips traversing said first strip, said traversing strips primarily engaging said glove mating element.

13. A football training aid comprising in combination:

a football having a lacing, said lacing having a plurality of either male or female fastener elements thereon;

a flexible glove having a plurality of fingers and thumb, said fingers having distal free ends positioned adjacent the fingertips of a user wearing said glove;

means for attaching a plurality of mating fastener elements to at least one of said distal free ends of said glove complementary to said fastener elements on said football lacing, said mating elements on said glove worn by a user releasably engaging said mating elements on said lacing, whereby said mating of said complementary fastener elements urges a user to properly grasp said football at said lacing by a user's fingertips within said glove.

14. The device as claimed in claim 13 wherein said glove mating elements disengage from said lacing mating elements upon a user throwing said football, said disengagement imparting a spin to the football.

15. The device as claimed in claim 13 wherein said mating elements on said football lacing comprise Velcro® loop elements.

16. The device as claimed in claim 15 wherein said mating elements on said football lacing comprise Velcro® hook elements.

17. The device as claimed in claim 13 wherein said glove mating elements are only on said fingers of said glove.

18. The device as claimed in claim 13 wherein said lacing comprises:

a first strip of lacing running along a seam of a football;

a plurality of strips traversing said first strip, said traversing strips primarily engaging said glove mating elements.

* * * * *